US005158380A

United States Patent [19]

Hauslaib et al.

[11] Patent Number: 5,158,380

[45] Date of Patent: Oct. 27, 1992

[54] APPARATUS FOR THE TRANSPORT OF PAPER IN PRINTERS

[75] Inventors: Wolfgang Hauslaib, Langenau; Günter Gomoll, Nersingen; Ulrich Buschmann, Elchingen, all of Fed. Rep. of Germany

[73] Assignee: Mannesmann Aktiengesellschaft, Dusseldorf, Fed. Rep. of Germany

[21] Appl. No.: 526,728

[22] Filed: May 22, 1990

[30] Foreign Application Priority Data

May 22, 1989 [DE] Fed. Rep. of Germany ..... 3917032
Nov. 27, 1989 [DE] Fed. Rep. of Germany ..... 3939506

[51] Int. Cl.[5] ..... B41J 11/50

[52] U.S. Cl. ..... 400/605; 400/616; 400/617; 400/636; 400/637.1; 400/636.3

[58] Field of Search ..... 400/605, 607, 607.2, 400/607.3, 608.2, 634, 636, 637.1, 636.3, 637,616.2, 616.3, 616, 617, 618

[56] References Cited

U.S. PATENT DOCUMENTS 4,606,663 8/1986 Christoph et al. ..... 400/605
4,815,879 3/1989 Yokoi ..... 400/636
4,936,696 6/1990 Steppe ..... 400/636.3
5,011,313 4/1991 Sato ..... 400/605
5,018,655 5/1991 Koire et al. ..... 400/636.3 X
5,030,024 7/1991 Seshimo ..... 400/605

FOREIGN PATENT DOCUMENTS 0116487 6/1985 Japan ..... 400/636.3
2125339 3/1984 United Kingdom ..... 400/616

*Primary Examiner*—Edgar S. Burr
*Assistant Examiner*—Christopher A. Bennett
*Attorney, Agent, or Firm*—Cohen, Pontani, Lieberman, & Pavane

[57] ABSTRACT

Apparatus for the selectably alternative feeding of single sheets and of endless webs of paper in a printer includes a guide roll (7), and first and second groups (8, 9) of friction rollers concurrently movable between first and second positions to define respective single sheet and endless web feeding modes of operation. In their first positions, the first friction rollers (8) contact the guide roll (7) to define a first single sheet feed channel (4) and the second friction rollers (9) contact the guide roll (7) to define a second single sheet feed channel (5). When shifted to their second positions, the first friction rollers (8) are displaced from their first position contact with the guide roll (7) to substantially eliminate the first single sheet feed channel (4), and the second friction roller (9) are lowered to form with the guide roll (7) an endless web feed channel (6).

25 Claims, 4 Drawing Sheets

APPARATUS FOR THE TRANSPORT OF PAPER IN PRINTERS

FIELD OF THE INVENTION

The present invention relates to apparatus for the transport of paper in printers such, for example, as dot matrix printers. It is more particularly directed to apparatus for controlled selection of either individual sheets or endless webs, for transport through the printer, by varying the positions of paper path-defining friction rollers and associated elements.

BACKGROUND OF THE INVENTION

Printers capable of transporting and handling multiple kinds of paper—such, for example, as single sheets on the one hand and endless webs on the other—and controllable for selectively switching between single sheet and endless web modes of operation, are known in the art. These arrangements are particularly useful and desirable when printing is to be effected on different kinds of paper being fed to a printer and the paper type currently not in use must be parked or maintained in a waiting or standby position.

An example of such an arrangement is disclosed in European Patent No. EP 0 186 132. The printing device disclosed therein includes a printing station past which individual sheets and endless webs to be printed are transported. A pair of friction rollers are disposed upstream of or prior to the printing station, in the direction of paper transport, for transporting or moving both individual sheets and endless webs. The apparatus includes a single feed channel formed of curved guides for individual sheets, and a feed channel for endless webs. This heretofore known arrangement requires that individual sheets be introduced into the printer only from the operator's side of the printer, while endless webs are fed from the back or rear side of the device. In addition, the apparatus does not enable the use of a drivable tractor of the customary flip-type construction, allowing sufficient room or space for accommodating only a so-called porcupine wheel for effecting endless web transport.

SUMMARY OF THE INVENTION

It is accordingly an object of the invention to provide a printer which incorporates separate feed channels for individual or single sheets and for endless webs of paper, the feed channels having only a single common pair of friction rollers arranged downstream of the printing station in the direction of paper transport so as to provide for a constant friction-driven transport of printer paper, whether of individual sheets or endless webs, while minimizing the duplication of or requirement for additional parts.

This and other objects are achieved in accordance with the invention by providing a printer having a printing station and a rotatable guide roll arranged upstream of or prior to the printing station, in the direction of paper transport, the guide roll having a length sufficient to extend for at least the full width of the paper upon which printing is to be effected. Associated with the guide roll are first and second groups of friction rollers which are movable, between first and second positions, respectively, into and out of surface-to-surface contact with the guide roll periphery and which are circumferentially spaced apart from each other about the guide roll. A feed channel for single sheets is thus formed by the combination of the guide roll and the first group of friction rollers in their first or contact position, and by the guide roll and second group of friction rollers in their first or raised or contact position; a feed channel for endless webs, on the other hand, is formed when the first group of friction rollers is moved to its second position and the second group of friction rollers is lowered to its second position, the endless webs being driven or transported forward by the combination of a conventional push tractor and a friction drive, common to both the single sheet and endless web modes of operation, arranged upstream of the printing station. There is in this manner provided a functional separation of feed channels for individual sheets and for endless webs whereby individual sheets can be selectively fed and transported through the printer from either the bottom of the printer or from the top by at least one group of friction rollers, and endless webs—with the first and second groups of friction rollers moved to their second positions—are transported by the push tractor to and beyond the printing station. This clear separation of the feed-channel functions for single sheets and for endless webs, through the provision of distinct functional elements for the separable forming of feed channels for individual sheets and for endless webs, assures improved disturbance-free introduction of multiple kinds of paper while providing a waiting or standby or parked position for that type of paper temporarily not in use.

This arrangement is furthermore advantageous for providing both a feed channel from below and another from above for single or individual sheets. And by providing the guide roll with a larger diameter than the friction rollers of the first and second groups, the positions of the feed channels are structurally determined for enhanced utility and operation.

The first group of friction rollers are provided with hubs and support springs connected thereto, with the ends of the support springs opposite the hubs resting on or proximate the printer base plate against cam projections of a first switch shaft. The first switch shaft is rotatable for varying the position of its cam projections and thereby effecting movement of the first group of friction rollers between their first and second positions.

The second group of friction rollers is mounted on one or a multiplicity of coaxial shaft sections or lengths which are, in turn, supported on a plurality of leaf springs. Each leaf spring rests, at one end, on a stationary support bearing and, at its other end, on a cam projection of a second switch shaft. The second switch shaft is also rotatable for varying the position of its cam projections and thereby effectuating movement of the second group of friction rollers between their first and second positions.

The first and second switch shafts extend substantially parallel to the shafts of the first and second friction roller groups and carry, in addition to the aforementioned cam projections, pairs of eccentric pins located at the switch shaft ends. These eccentric pins engage at least one push rod common to both switch shafts and supported for longitudinal sliding movement on the printer base plate. A gear wheel is mounted for axial displacement under the urgency of a spring on a tractor shaft which is rotatable for driving the endless web push tractor, the gear wheel meshing in its engaged position with the pinion of an operable electric drive motor. A coupling shaft extends substantially perpendicular to the tractor shaft and bears radial projections which lie against the front face of the tractor shaft-carried gear wheel. A pinion is secured to the end of the coupling shaft and engages a spur gearing on the longitudinally-movable push rod. These elements cooperate to effectuate switching of the paper feeding mode, i.e. between the individual sheet and endless web modes of printer operation.

The coupling shaft is additionally provided with a hand-operable knob for enabling manual switching between the two operating modes. Mode switching can also be carried out, however, in a more automated fashion since the pinion which is secured to the end of the coupling shaft is disposed for engagement with an output gear of a transmission unit powered by a geared electrically-driven motor.

In an advantageous alternative embodiment of the invention, the primary difference with respect to the first-disclosed apparatus is that the first group of friction rollers is disposed for movability so as to provide a variable force with which the friction rollers are applied or held or directed against the guide roll. That is, movement of the first group of friction rollers from their first to their second positions, so as to switch the printer from its single sheet to its endless web mode of operation, results in a variable reduction in the urgency with which the first friction rollers are maintained in contact with the guide roll surface. This functionality is in contradistinction to the first-disclosed embodiment of the invention wherein movement of the first group of friction rollers from its first to its second position results in the friction rollers being displaced away from and out of direct contact or abutment with the guide roll surface.

Thus, in this alternate embodiment, the support springs of the first group of friction rollers are integrally secured at their ends opposite the hubs and rollers to at least one base plate member that carries a spring pin. A compression spring is seated on or about the spring pin and is captured between the base plate member and the printer base plate. This arrangement structurally provides the variable force with which the first friction rollers are maintained in surface-to-surface contact with the guide roll.

Other objects and features of the present invention will become apparent from the following detailed description when considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein similar reference characters denote similar elements throughout the several views.

DETAILED DESCRIPTION OF THE PREFERRED EMBODIMENTS

The inventive apparatus for the transport of paper in printers permits the user-selectable feeding of individual or single sheets 1, either from the top or the bottom of the printer, and the feeding of endless webs 2 from the back or rear 3 of the printer.

Figure 1:
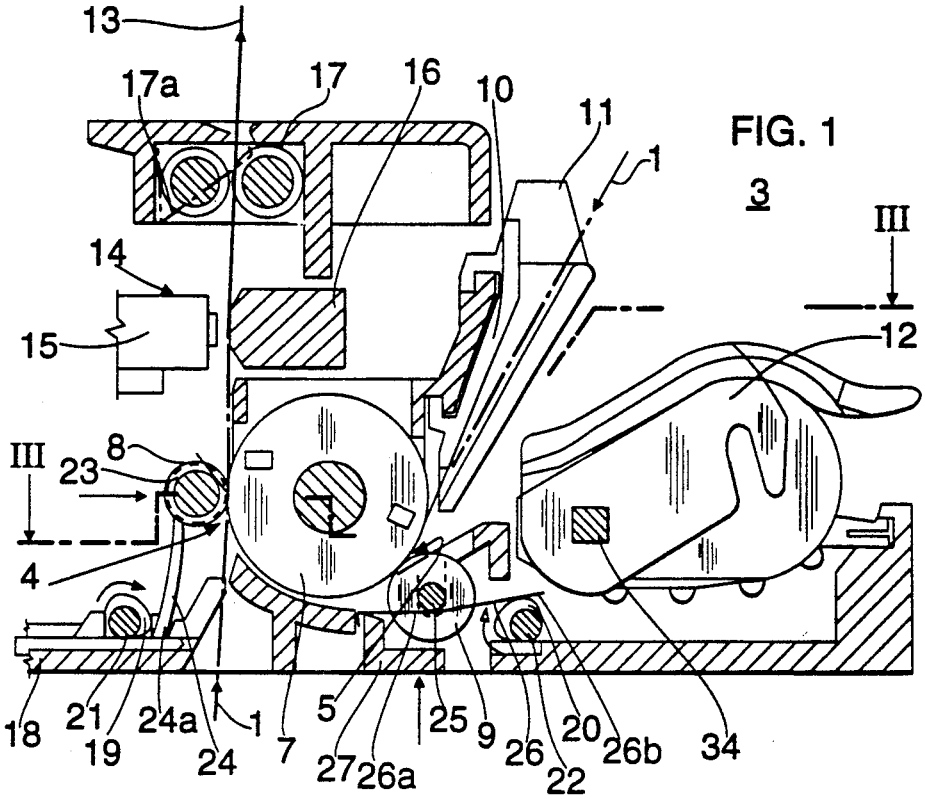
FIG. 1 is a vertical cross-sectional side view through a preferred embodiment of an apparatus in accordance with the present invention and depicting its operation in single sheet feed mode.

For this purpose, there are formed feed channels 4 and 5 for individual or single sheets 1 and a feed channel 6 for endless webs 2. A rotatable guide roll 7 extends along the entire width of the paper on which printing is to occur and, in addition, along the full length of groups of friction rollers which, as hereinafter described, cooperate with the guide roll to form the feed channels and enable the feeding of the paper. As seen in FIG. 1, the feed channel 4 for single sheets 1 is formed by the combination of the guide roll 7 and a first group of friction rollers 8, and the feed channel 5 for single sheets is formed of the combination of the guide roll and a second group of friction rollers 9. In front or upstream of the feed channel 5, in the direction of paper movement, a feed shaft 11 including guide ribs 10 is disposed for receiving and guiding single sheets 1 into the feed channel 5. Upon lowering of the second group of friction rollers 9 so as to carry them from their first to their second positions, the functionally-independent feed channel 6 for endless webs 2 is defined, the webs 2 being pushed or driven or transported into the feed channel 6 by a push tractor 12 that is freely accessible from above the same.

Figure 2:
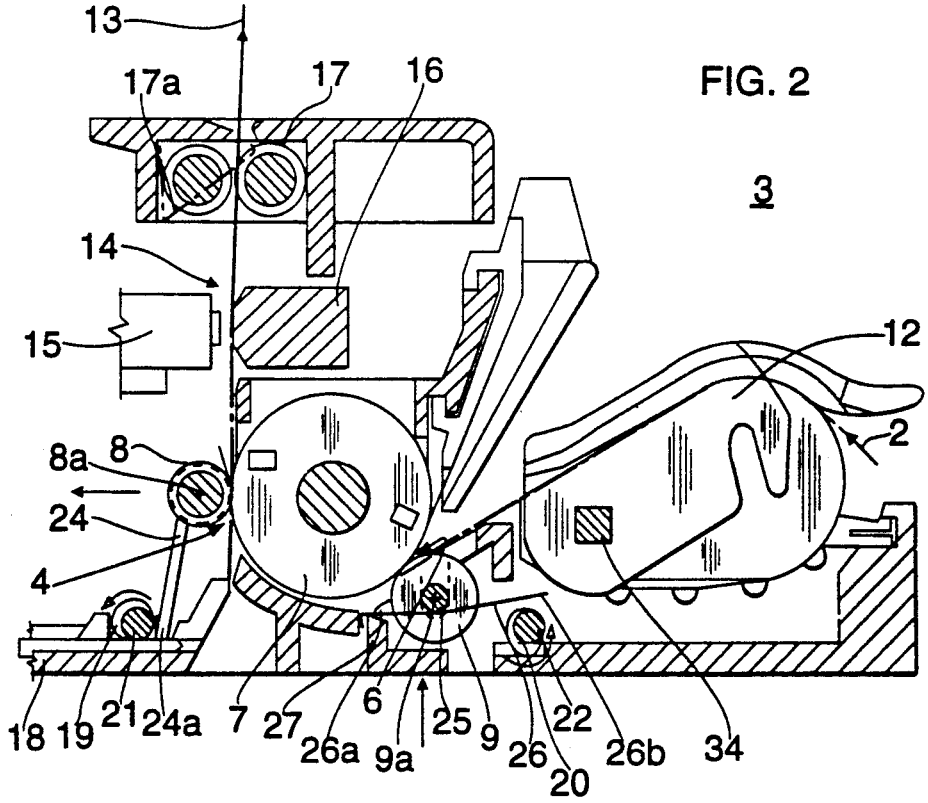
FIG. 2 is a vertical cross-sectional side view similar to that shown in FIG. 1 and depicting operation in endless web feed mode.
Figure 3:
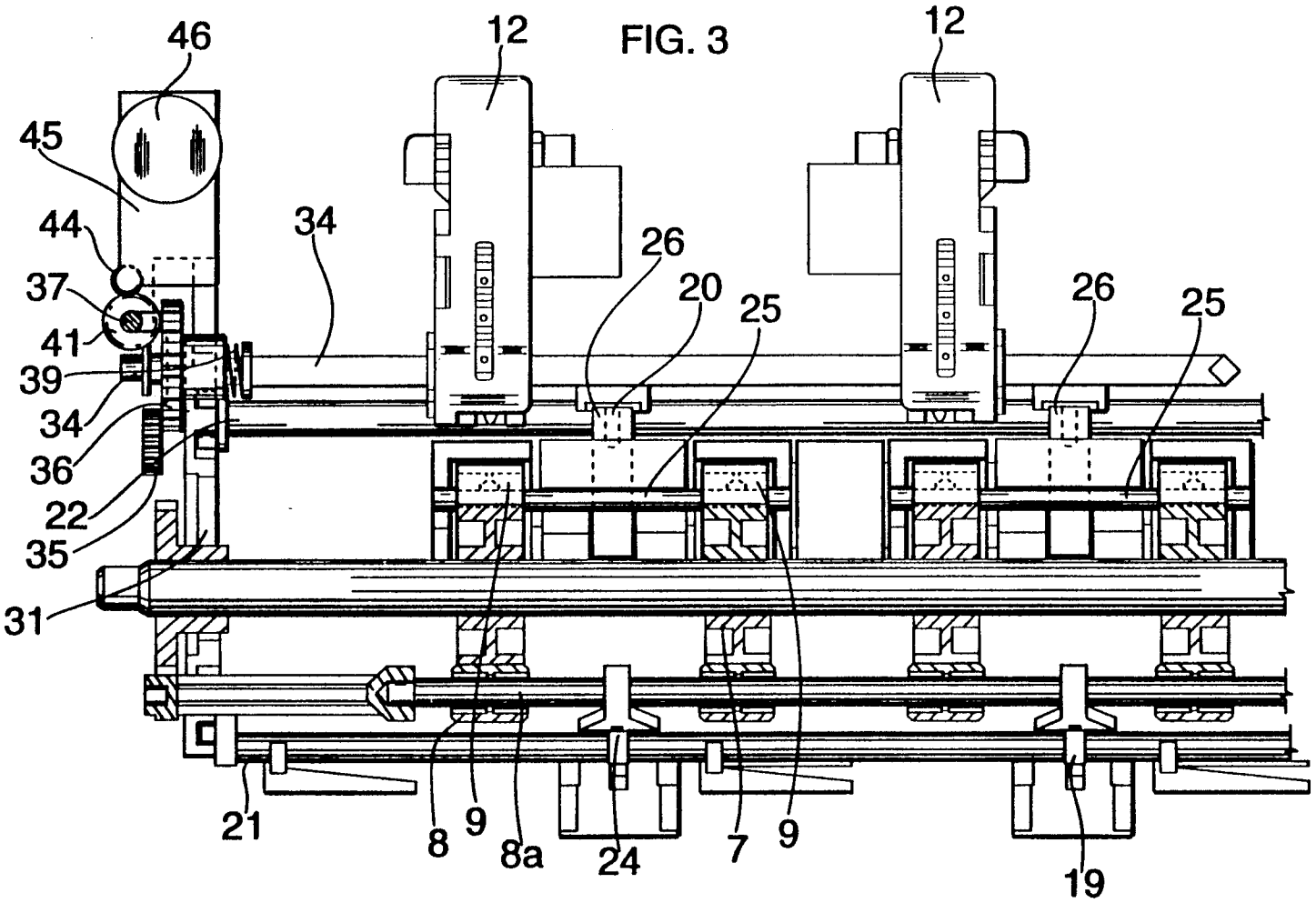
FIG. 3 is a top view taken along the lines III–III in FIG. 1.

Each of the components of the apparatus thus far described are located in front or upstream, as seen in the paper transport direction 13, of a printing station 14 at which characters and/or symbols are imprinted on the transported paper substrate. The printing station is more particularly formed of a dot matrix-needle printing head 15 and a printing backing or member or abutment 16. Both single sheets 1 and endless webs 2 are transported in the paper movement direction 13 by a friction drive 17 disposed behind or downstream of the printing station 14. The friction drive 17 may, by way of example, comprise a pair of friction rollers as shown in FIGS. 1 and 2, or a single friction roller together with an associated application arm **17*a*** as illustrated by dotted lines in the same Figures.

In order to suitably form the paper feed channels, the guide roll 7 is preferably provided with a larger diameter than the friction rollers 8, 9 of the first and second groups, respectively. Specific structural details of the apparatus may, of course, be varied through appropriate selection of the diameter of the guide roll 7.

Details of that portion of the apparatus by which the printer is switchable between its single sheet and endless web feeding modes will now be described. These structural elements cooperate to alternately form the feed channels 4, 5 or the feed channel 6 for single sheet and endless web paper feeding, respectively. Thus, in switching from the single sheet to the endless web mode of operation, the first and second groups of friction rollers 8, 9 are moved from their first to their second positions. More particularly, the first group of friction rollers 8 is moved from a first position (FIG. 1) in which the rollers 8 are disposed in surface-to-surface abutment or contact with the guide roll 7, so as to define the single sheet feed channel 4, to a second position (FIG. 2) in which the rollers 8 are displaced away from or out of contact with the guide roll. The second group of friction rollers 9, in switching from the single sheet to the endless web feeding modes of operation, is lowered from the first position (FIG. 1) in which the single sheet feed channel 5 is defined to the second position (FIG. 2) in which the endless web feed channel 6 is formed.

The printer base plate 18, which may also include integral or attached or associated side walls (not shown), carries or supports the shafts 8*a* of the friction rollers 8 and the substantially parallel-extending shafts of the rotatable guide rolls 7. First and second switch shafts 21, 22—which carry radial cam projections 19, 20, respectively—also extend substantially parallel to the guide roll shaft and the friction roller shafts 8*a*. The switch shafts 21, 22 are supported, preferably at multiple points, for rotation on the printer base plate 18.

The friction roller shafts 8*a* are provided with hubs 23 to which spaced apart support springs 24 are secured. A cam projection 19 lies against the end 24*a* of each support spring 24.

The second group of friction rollers 9 is mounted, in the disclosed embodiment of the invention, on a plurality of coaxial partial shafts or shaft sections 25, the shafts 25 being supported on a multiplicity of spaced apart leaf springs 26. Each leaf spring 26 has a first end 26*a* which rests on a fixed support bearing 27 and a second end 26*b* that is supported atop one of the cams 20 of the second switch shaft 22.

As seen in FIGS. 4 to 7, each of the switch shafts 21, 22 carries, at least at its end 28, a pair of eccentric pins 29, 30. These pins 29, 30 engage one or a plurality of push rods 31 that are supported for longitudinal sliding movement in and along a guide defined in the printer base plate 18. The eccentric pin 29, in conjunction with the push rod 31, forms a link bracket, the first switch shaft end 28 being rotatable about a central shaft 32 of the pin 29. The second eccentric pin 30 is movable in and along a free groove 33 of the push rod 31.

Figure 4:
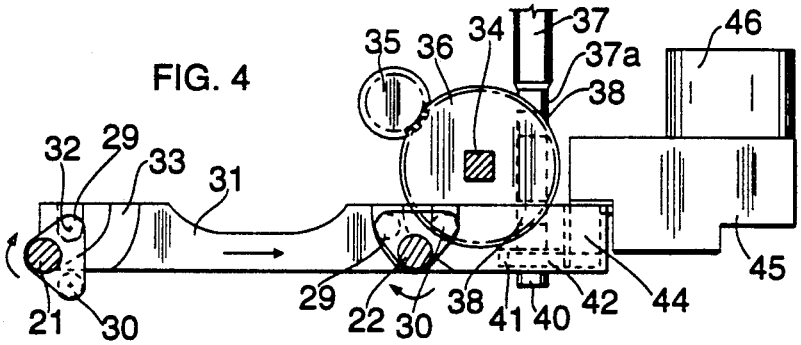
FIG. 4 is a transverse sectional view through the two parallel switch shafts in single sheet feed mode, as in FIG. 1.
Figure 5:
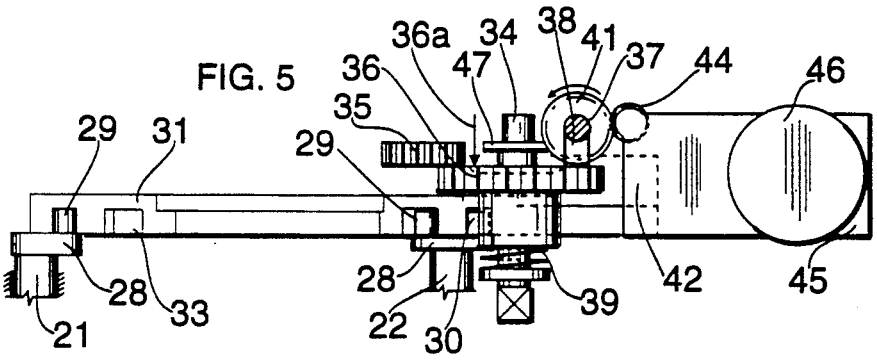
FIG. 5 is a top plan view of the transverse section of FIG. 4.

Upon displacement of the push rod 31 to the right, as seen in FIGS. 4 and 5, the first switch shaft 21 rotates clockwise (in the Figures) about its axis. This results in a corresponding clockwise rotation of the cam projections 19 whereby the first group of friction rollers 8 is displaced into surface-to-surface contact with the guide rolls 7 to form the feed channel 4—i.e. into the single sheet feed mode of operation (FIG. 1). At the same time, the end 28 of the second switch shaft 22 also undergoes a clockwise rotation, carrying therewith its cam projections 20 whereby the leaf springs 26 are raised to their FIG. 1 position. As the springs 28 are raised, they carry the shafts 9*a* of the second group of friction rollers 9 whereby the rollers 9 are placed in surface-to-surface abutment with the guide rolls 7 to thereby form or define the single sheet mode feed channel 5 (FIG. 1). Thus, rightward displacement of the push rod 31 forms the feed channels 4, 5 and thereby places the apparatus in its single sheet feed mode of operation.

Figure 6:
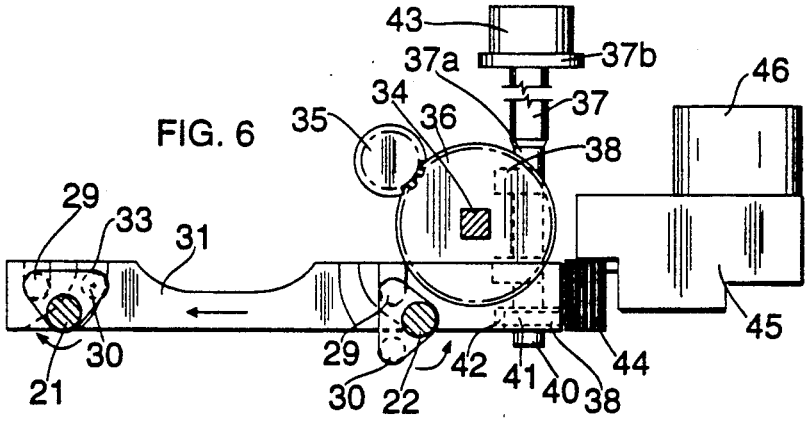
FIG. 6 is a transverse sectional view through the two parallel switch shafts in endless web feed mode, as in FIG. 2.
Figure 7:
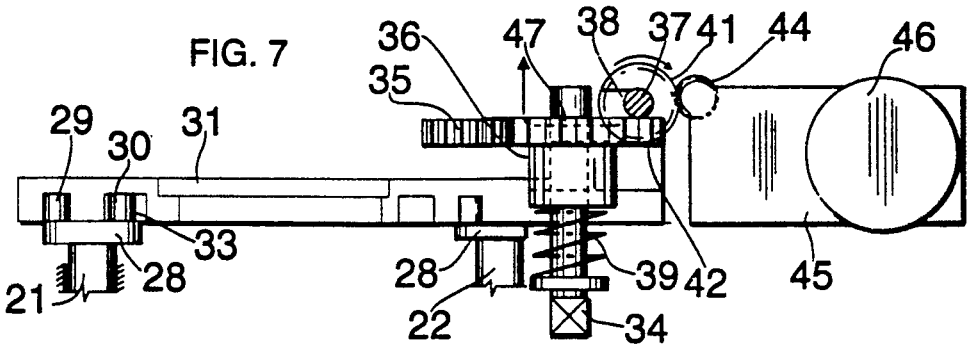
FIG. 7 is a top plan view of the transverse section of FIG. 6.

Upon leftward displacement of the one or plural push rods 31, as shown in FIGS. 6 and 7, the end 28 of the first switch shaft 21 undergoes a counterclockwise rotation whereby the eccentric pin 30 enters and moves along the groove 33. In the course of this rotation, all of the cam projections 19 are carried through a corresponding clockwise rotation whereby the support springs 24 displace the friction roller shafts 8*a* to the left in FIG. 1; the first group of friction rollers 8 is thereby carried or moved out of surface-to-surface contact with the guide roll 7, thus eliminating the single sheet feed channel 4. Leftward displacement of the push rod(s) 31 correspondingly effects a counterclockwise rotation of the second switch shaft 22 and its cam projections 20, by which the leaf springs 26 are lowered from their FIG. 1 to their FIG. 2 position. Lowering of the springs 26 carries with them the friction roller shafts 9*a*, whereby the second group of friction rollers 9 are correspondingly lowered so as to eliminate the single sheet feed channel 5 and form or establish or define the endless web feed channel 6. Accordingly, leftward displacement of the one or plural push rods 31 operatively switches or transforms the printer apparatus from its single sheet to its endless web feed mode of operation.

The selectable or controllable switching of the apparatus between the single sheet feed and endless web feed modes of operation can be carried out either manually or in an automated manner. The push tractor 12 is operatively driven by a tractor shaft 34, the shaft 34 being operatively rotated by an electric motor (not shown) that carries or otherwise rotates a pinion 35. A gear wheel 36 is supported for axial displacement, under the urgency of a spring 39, on the tractor drive shaft 34. In its engaged state, illustrated in FIGS. 6 and 7, the gear wheel 36 meshes with the motor-driven pinion 35 so that the tractor shaft 34 is then rotatably driven for feeding an endless web 2.

A coupling shaft 37 which extends substantially perpendicular to the tractor drive shaft 34 carries, on its shaft 37*a*, cams 38 which, in their FIG. 5 position, rest against one face or side 36*a* of the tractor gear wheel 36. The spring 39 urges the gear wheel 36 toward the shaft 37*a* until the wheel 36 rests against a movement-limiting safety disk 47. A pinion 41 mounted on the end 40 of the coupling shaft 37 engages a spur gearing 42 which is defined as a part of the push rod 31. In addition, a manually-rotatable or hand knob 43 is carried on the upper, free end 37*b* of the coupling shaft 37 (FIG. 6). The setting of the selected paper feed mode of operation can accordingly be carried out through rotation of the hand knob 43, by which the coupling shaft 37 is rotatable between the positions shown in FIGS. 4 and 5, on the one hand, and FIGS. 6 and 7, on the other. FIGS. 6 and 7 depict the endless web feeding mode of operation wherein the cams 38 are rendered inactive so as to permit the gear wheel 36 to engage the pinion 35 and thereby transfer the pinion rotation to the tractor shaft 34 for operating the push tractor 12 and thereby advancing the endless web 2. The disengaged position of the gear wheel 36, seen in FIGS. 4 and 5, accordingly corresponds to the single sheet feed mode of operation.

Automated switching of the operative mode is effected by the geared electric motor 46. The motor 46 is connected to a transmission unit 45 having an output gear wheel 44. The gear wheel 44 engages the pinion 41 secured to the end 40 of the coupling shaft 37. The alternative selection of the single sheet or the endless web feed modes of operation can therefore be carried out by controlled operation of the electric motor 46 to bidirectionally rotate the output gear wheel 44.

The operation of this first and currently preferred embodiment of the inventive apparatus for selectively switching between single sheet and endless web modes of paper feeding should now be apparent. In the first position of the friction rollers 8,9—corresponding to the single sheet feed mode—both the first and second groups of friction rollers 8,9 are maintained in surface-to-surface contact with the rotatable guide rolls 7 so as to frictionally contact the single sheets being fed through the printer and thereby exert a pressing force on the paper. When the friction rollers 8, 9 are moved to their respective second positions, however, this pressing force of the friction rollers against the guide rolls 7 and on the endless web 2 being fed through the printer is immediately reduced to zero or substantially zero by the leftward (in FIG. 1) displacement of the first group of friction rollers 8 and the lowering of the second group of friction rollers 9. Thus, in moving from single sheet to endless web feeding modes, the single sheet feed channels 4 and 5 are eliminated and only the endless web feed channel 6 is present for receiving the endless web 2.

Figure 8:
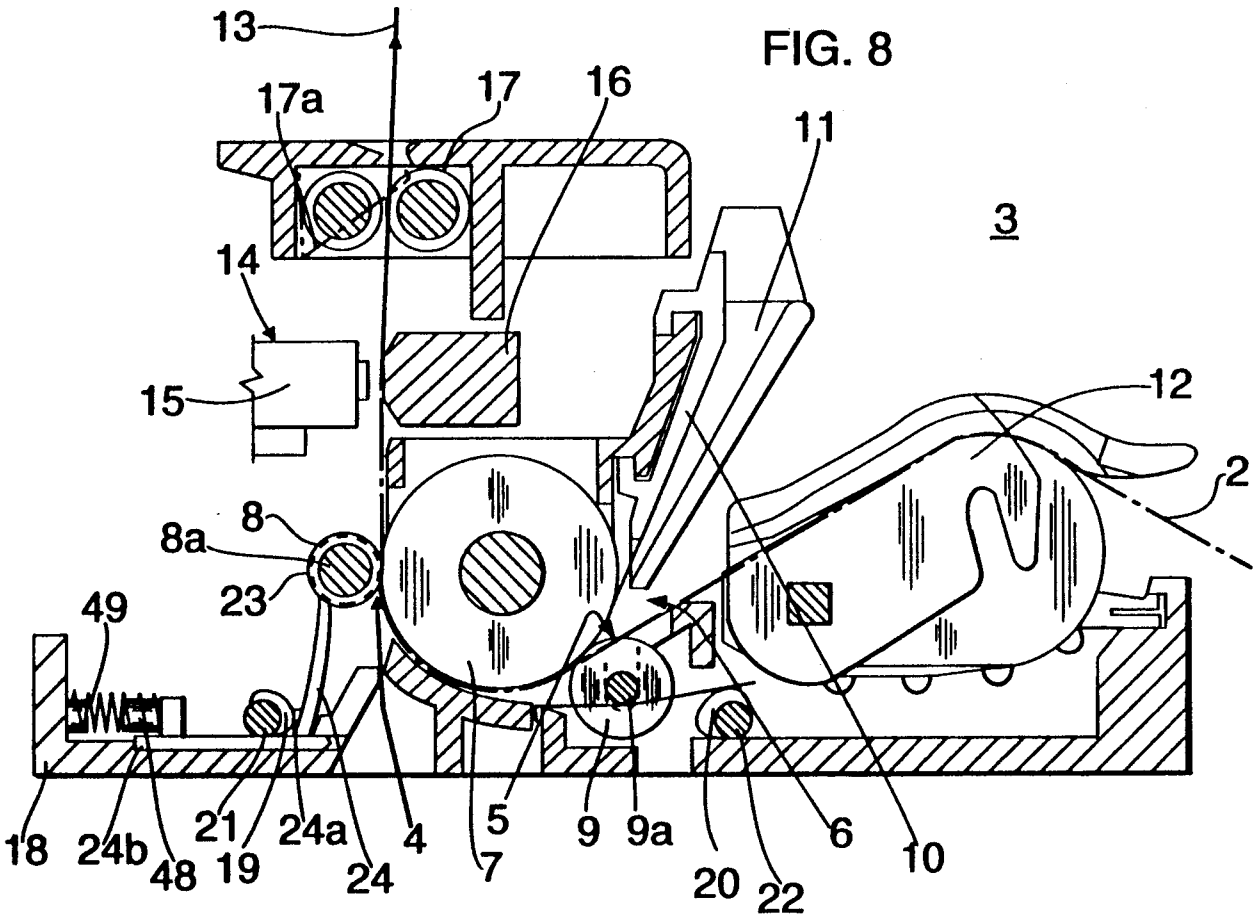
FIG. 8 is a vertical cross-sectional side view generally corresponding to FIG. 1 of an apparatus constructed in accordance with an alternative embodiment of the invention.

An alternative embodiment of the apparatus of the invention is illustrated in FIG. 8. In most respects, the various elements which cooperatively form this alternate embodiment are and function in a manner identical to the corresponding elements of the first-disclosed and currently preferred form of the invention shown in FIGS. 1 to 7. The primary difference, as can be seen in FIG. 8, lies in the elements associated with and the manner of operative displacement of the first group of friction rollers 8. In particular, the friction rollers 8 are arranged for applying a variable pressure against the guide rolls 7.

Thus, associated with the first group of friction rollers 8 are supporting springs 24. In a preferred form of this alternate embodiment, each of the supporting springs 24 is integrally or unitarily connected, at one of its ends, to the friction roller shafts **8*a* and, at its other end 24*a*, to a base plate member 24*b*. The spring 24, base plate 24*b* and friction roller shaft 8*a* may all advantageously be fabricated of a single piece of flexibly resilient plastic material. The base plate member 24*b* carries an integral spring pin 48 about which a compression spring 49 is supportingly receivable with the spring extending between the plate member 24*b* and the printer base plate 18. In this manner, the plate member 24*b* is urged under the spring force to the right (in FIG. 8) whereby the friction rollers 8 are pressed with a selectable force against the guide roll 7. The compression spring 49 is of such a nature that, depending upon the rotative position of the first switch shaft 21 and its cam projections 19, either a greater or a lesser setting force acts on the first group of friction rollers 8 for urging the rollers 8 into surface-to-surface contact with the guide roll 7. Thus, in the second or endless web feed mode of operation the first group of friction rollers 8 are sufficiently displaced from their first or single sheet feed positions only so as to apply a reduced pressing force of the rollers 8 against the guide rolls 7 and thereby enable the feeding of endless webs 2 between the friction rolls 8 and the guide roll 7**.

While there have been shown and described and pointed out fundamental novel features of the invention as applied to preferred embodiments thereof, it will be understood that various omissions and substitutions and changes in the form and details of the apparatus illustrated and in its operation may be made by those skilled in the art without departing from the spirit of the invention. It is the intention, therefore, to be limited only as indicated by the scope of the claims appended hereto.

What is claimed is:

1. Apparatus for the selectably alternative feeding of single sheets and of endless webs of paper in a printer having a printing station (14), a bottom-disposed base plate having an opening through which single sheets are feedable to the printing station from below the printer for printing on the single sheets, an endless web push tractor (12), inlet means for feeding single sheets to the printing station from above the printer for printing on the single sheets, and a friction drive (17) for both single sheets and endless webs and disposed downstream of the printing station, the apparatus comprising:

a guide roll (7) separated from and disposed upstream of the printing station;

a first group of friction rollers (8) movable between a first position in which the rollers (8) contact the guide roll (7) for defining a first feed channel (4) through which single sheets fed from the base plate opening and from the inlet means are transportable to the printing station, and a second position in which the friction rollers (8) are displaced from said first position of contact with the guide roll (7) for enabling the transport of endless webs from the push tractor to the printing station, the base plate opening, said first feed channel and the printing station defining a path from the base plate opening to the printing station for the single sheets fed to the printer through the base plate opening; and a second group of friction rollers (9) spaced from said first group of friction rollers (8) circumferentially about said guide roll (7), said second friction rollers being movable between a first, relatively raised position of contact with the guide roll (7) for defining a second feed channel (5) through which single sheets from the inlet means are transportable to the printing station and second, relatively lower position for defining a third feed channel (6) through which endless webs are transportable from the push tractor (12) to the printing station, said second friction rollers being disposed remote from and out of said path of single sheets fed to the printer through the base plate opening.

2. Apparatus in accordance with claim 1, wherein the guide roll (7) has a diameter larger than the diameters of the friction rollers (8, 9) of the first and second groups.

3. Apparatus in accordance with claim 1, further comprising:

a printer base plate (18);

a rotatable switch shaft (21) carrying a cam projection (19);

a hub (23) on said first group of friction rollers (8); and a support spring (24) secured to said hub (23), said support spring (24) having an end (**24*a*) disposed proximate said base plate (18) in abutment with said cam projection (19) so that, with rotation of said switch shaft, said spring end (24*a*) is moved so as to move said first friction rollers (8**) between their first and second positions.

4. Apparatus in accordance with claim 2, further comprising:

a printer base plate (18);

a rotatable switch shaft (21) carrying a cam projection (19);

a hub (23) on said first group of friction rollers (8); and a support spring (24) secured to said hub (23), said support spring (24) having an end (**24*a*) disposed proximate said base plate (18**) in abutment with said cam projection (19) so that, with rotation of said switch shaft, said spring end (24a) is moved so as to move said first friction rollers (8) between their first and second positions.

5. Apparatus in accordance with claim 1, wherein said second group of friction rollers (9) includes a supporting shaft (25), and further comprising:

a rotatable switch shaft (22) carrying a cam projection (20);

a fixed support bearing (27); and a leaf spring having a first end (26a) supported on said support bearing (27) and a second end (26b) supported on said cam projection (20) of said switch shaft (22) so that, with rotation of said switch shaft, said leaf spring (26), said supporting shaft (25) and said second friction rollers (9) are raised and lowered so as to move said second friction rollers (9) between their first and second positions, respectively.

6. Apparatus in accordance with claim 2, wherein said second group of friction rollers (9) includes a supporting shaft (25), and further comprising:

a rotatable switch shaft (22) carrying a cam projection (20);

a fixed support bearing (27); and a leaf spring having a first end (26a) supported on said support bearing (27) and a second end (26b) supported on said cam projection (20) of said switch shaft (22) so that, with rotation of said switch shaft, said leaf spring (26), said supporting shaft (25) and said second friction rollers (9) are raised and lowered so as to move said second friction rollers (9) between their first and second positions, respectively.

7. Apparatus for the selectably alternative feeding of single sheets and of endless webs of paper in a printer having a printing station (14), an endless web push tractor (12) and a friction drive (17) for both single sheets and endless webs and disposed downstream of the printing station, the apparatus comprising:

a guide roll (7) disposed upstream of the printing station;

a first group of friction rollers (8) movable between a first position in which the rollers (8) contact the guide roll (7) for defining a first feed channel (4) through which single sheets are transportable, and a second position in which the friction rollers (8) are displaced from said first position of contact with the guide roll (7) for enabling the transport of endless webs through said apparatus;

a second group of friction rollers (9) spaced from said first group of friction rollers (8) circumferentially about said guide roll (7), said second friction rollers being movable between a first, relatively raised position of contact with the guide rolls (7) for defining a second feed channel (5) through which single sheets are transportable and a second, relatively lower position for defining a third feed channel (6) through which endless webs are transportable by means of the push tractor (12) and the friction drive (17);

wherein said first group of friction rollers (8) have a shaft (8a) and said second group of friction rollers (9) have a shaft (9a);

a first rotatable switch shaft (21) having a cam projection (19);

a second rotatable switch shaft (22) having a cam projection (20);

a push rod (31) disposed for movement between first and second positions and including a spur toothing (42);

a pair of eccentric pins (29, 30) carried on an end (28) of each f the first and second switch shafts (21, 22) and disposed in engagement with said push rod (31) so that movement of said push rod (31) causes a rotation of each of said first and second switch shafts (21, 22);

a tractor shaft (34) rotatable for driving the push tractor (12);

a motor-driven pinion (35);

a gear wheel (36) carried on said tractor shaft (34) and axially-movable therealong between a first position of engagement with said motor-driven pinion (35) and a second position of nonengagement with said motor-driven pinion, said gear wheel having a front face (36a);

a rotatable coupling shaft (37) disposed substantially perpendicular to the tractor shaft (34) and carrying a cam (38) in abutment with said gear wheel front face (36a); and a second pinion (41) mounted on an end (40) of said coupling shaft (37) and in meshed engagement with said push rod spur toothing (42) so that rotation of said coupling shaft (37) moves said push rod (31) between its first and second positions.

8. Apparatus in accordance with claim 7, further comprising:

a geared electrically-driven motor (46); and a transmission (45) connected to said electrically-driven motor (46) and including an output gear wheel (44) disposed in meshed engagement with said second pinion (41) for motor-driven rotation of said coupling shaft (37).

9. Apparatus in accordance with claim 7, further comprising a hand knob (43) on an upper free end (37a) of said coupling shaft (37) for enabling user-driven rotation of said coupling shaft.

10. Apparatus in accordance with claim 9, further comprising:

a geared electrically-driven motor (46); and a transmission (45) connected to said electrically-driven motor (46) and including an output gear wheel (44) disposed in meshed engagement with said second pinion (41) for motor-driven rotation of said coupling shaft (37).

11. Apparatus for the selectably alternative feeding of single sheets and of endless webs of paper in a printer having a printing station (14), an endless web push tractor (12) and a friction drive (17) for both single sheets and endless webs and disposed downstream of the printing station, the apparatus comprising:

a guide roll (7) disposed upstream of the printing station;

a first group of friction rollers (8) movable between a first position in which the rollers (8) contact the guide roll (7) for defining a first feed channel (4) through which single sheets are transportable, and a second position in which the friction rollers (8) are displaced from said first position of contact with the guide roll (7) for enabling the transport of endless webs through said apparatus;

a second group of friction rollers (9) spaced from said first group of friction rollers (8) circumferentially about said guide roll (7), said second friction rollers being movable between a first, relatively raised position of contact with the guide roll (7) for defining a second feed channel (5) through which single sheets are transportable and a second, relatively lower position for defining a third feed channel (6) through which endless webs are transportable by means of the push tractor (12) and the friction drive (17);

wherein said first group of friction rollers (8) have a shaft (8a), said second group of friction rollers (9) have a shaft (9a), and the guide roll (7) has a diameter larger than the diameters of the friction rollers (8, 9) of the first and second groups;

a first rotatable switch shaft (21) having a cam projection (19);

a second rotatable switch shaft (22) having a cam projection (20);

a push rod (31) disposed for movement between first and second positions and including a spur toothing (42);

a pair of eccentric pins (29, 30) carried on an end (28) of each of the first and second switch shafts (21, 22) and disposed in engagement with said push rod (31) so that movement of said push rod (31) causes a rotation of each of said first and second switch shafts (21, 22);

a tractor shaft (34) rotatable for driving the push tractor (12);

a motor-driven pinion (35);

a gear wheel (36) carried on said tractor shaft (34) and axially-movable therealong between a first position of engagement with said motor-driven pinion (35) and a second position of nonengagement with said motor-driven pinion, said gear wheel having a front face (36a);

a rotatable coupling shaft (37) disposed substantially perpendicular to the tractor shaft (34) and carrying a cam (38) in abutment with said gear wheel front face (36a); and a second pinion (41) mounted on an end (40) of said coupling shaft (37) and in meshed engagement with said push rod spur toothing (42) so that rotation of said coupling shaft (37) moves said push rod (31) between its first and second positions.

12. Apparatus in accordance with claim 11, further comprising:

a geared electrically-driven motor (46); and a transmission (45) connected to said electrically-driven motor (46) and including an output gear wheel (44) disposed in meshed engagement with said second pinion (41) for motor-driven rotation of said coupling shaft (37).

13. Apparatus in accordance with claim 11, further comprising a hand knob (43) on an upper free end (37a) of said coupling shaft (37) for enabling user-driven rotation of said coupling shaft.

14. Apparatus in accordance with claim 13, further comprising:

a geared electrically-driven motor (46); and a transmission (45) connected to said electrically-driven motor (46) and including an output gear wheel (44) disposed in meshed engagement with said second pinion (41) for motor-driven rotation of said coupling shaft (37).

15. Apparatus for the selectably alternative feeding of single sheets of endless webs of paper in a printer having a printing station (14), an endless web push tractor (12) and a friction drive (17) for both single sheets and endless webs and disposed downstream of the printing station, the apparatus comprising:

a guide roll (7) disposed upstream of the printing station;

a first group of friction rollers (8) movable between a first position in which the rollers (8) contact the guide roll (7) for defining a first feed channel (4) through which single sheets are transportable, and a second position in which the friction rollers (8) are displaced from said first position of contact with the guide roll (7) for enabling the transport of endless webs through said apparatus;

a second group of friction rollers (9) spaced from said first group of friction rollers (8) circumferentially about said guide roll (7), said second friction rollers being movable between a first, relatively raised position of contact with the guide roll (7) for defining a second feed channel (5) through which single sheets are transportable and a second, relatively lower position for defining a third feed channel (6) through which endless webs are transportable by means of the push tractor (12) and the friction drive (17);

wherein said first group of friction rollers (8) have a shaft (8a), and said second group of friction rollers (9) have a shaft (9a);

a first rotatable switch shaft (21) having a cam projection (19);

a second rotatable switch shaft (22) having a cam projection (20);

a push rod (31) disposed for movement between first and second positions and including a spur toothing (42);

a pair of eccentric pins (29, 30) carried on an end (28) of each of the first and second switch shafts (21, 22) and disposed in engagement with said push rod (31) so that movement of said push rod (31) causes a rotation of each of said first and second switch shafts (21, 22);

a tractor shaft (34) rotatable for driving the push tractor (12);

a motor-driven pinion (35);

a gear wheel (36) carried on said tractor shaft (34) and axially-movable therealong between a first position of engagement with said motor-driven pinion (35) and a second position of nonengagement with said motor-driven pinion, said gear wheel having a front face (36a);

a rotatable coupling shaft (37) disposed substantially perpendicular to the tractor shaft (34) and carrying a can (38) in abutment with said gear wheel front face (36a);

a second pinion (41) mounted on an end (40) of said coupling shaft (37) and in meshed engagement with said push rod spur toothing (42) so that rotation of said coupling shaft (37) moves said push rod (31) between its first and second positions;

a printer base plate (18);

a hub (23) on said first group of friction rollers (8); and a support sprint (24) secured to said hub (23), said supporting spring (24) having an end (24a) disposed proximate said base plate (18) in abutment with said cam projection (19) so that, with rotation of said switch shaft, said spring end (24a) is moved so as to move said first friction rollers (8) between their first and second positions.

16. Apparatus in accordance with claim 15, further comprising:

a geared electrically-driven motor (46); and a transmission (45) connected to said electrically-driven motor (46) and including an output gear wheel (44) disposed in meshed engagement with said second pinion (41) for motor-drive rotation of said coupling shaft (37).

17. Apparatus in accordance with claim 15, further comprising a hand knob (43) on an upper free end (37*a*) of said coupling shaft (37) for enabling user-driven rotation of said coupling shaft.

18. Apparatus in accordance with claim 17, further comprising:

a geared electrically-driven motor (46); and a transmission (45) connected to said electrically-driven motor (46) and including an output gear wheel (44) disposed in meshed engagement with said second pinion (41) for motor-driven rotation of said coupling shaft (37).

19. Apparatus for the selectably alternative feeding of single sheets and of endless webs of paper in a printer having a printing station (14), an endless web push tractor (12) and a friction drive (17) for both single sheets and endless webs and disposed downstream of the printing station, the apparatus comprising:

a guide roll (7) disposed upstream of the printing station;

a first group of friction rollers (8) movable between a first position in which the rollers (8) contact the guide roll (7) for defining a first feed channel (4) through which single sheets are transportable, and a second position in which the friction rollers (8) are displaced from said first position of contact with the guide roll (7) for enabling the transport of endless webs through said apparatus;

a second group of friction rollers (9) spaced from said first group of friction rollers (8) circumferentially about said guide roll (7), said second friction rollers being movable between a first, relatively raised position of contact with the guide roll (7) for defining a second feed channel (5) through which single sheets are transportable and a second, relatively lower position for defining a third feed channel (6) through which endless webs are transportable by means of the push tractor (12) and the friction drive (17);

wherein said first group of friction rollers (8) have a shaft (8*a*), and said second group of friction rollers (9) have a shaft (9*a*), the guide roll (7) has a diameter larger than the diameters of the friction rollers (8, 9) of the first and second groups;

a first rotatable switch shaft (21) having a cam projection (19);

a second rotatable switch shaft (22) having a cam projection (20);

a push rod (31) disposed for movement between first and second positions and including a spur toothing (42);

a pair of eccentric pins (29, 30) carried on an end (28) of each of the first and second switch shafts (21, 22) and disposed in engagement with said push rod (31) so that movement of said push rod (31) causes a rotation of each of said first and second switch shafts (21, 22);

a tractor shaft (34) rotatable for driving the push tractor (12);

a motor-driven pinion (35);

a gear wheel (36) carried on said tractor shaft (34) and axially-movable therealong between a first position of engagement with said motor-driven pinion (35) and a second position of nonengagement with said motor-driven pinion, said gear wheel having a front face (36*a*);

a rotatable coupling shaft (37) disposed substantially perpendicular to the tractor shaft (34) and carrying a cam (38) in abutment with said gear wheel front face (36*a*);

a second pinion (41) mounted on an end (40) of said coupling shaft (37) and in meshed engagement with said push rod spur toothing (42) so that rotation of said coupling shaft (37) moves said push rod (31) between its first and second positions;

a printer base plate (18);

a hub (23) on said first group of friction rollers (8); and a support spring (24) secured to said hub (23), said support spring (24) having an end (24*a*) disposed proximate said base plate (18) in abutment with said cam projection (19) so that, with rotation of said switch shaft, said spring end (24*a*) is moved so as to move said first friction rollers (8) between their first and second positions.

20. Apparatus in accordance with claim 19, further comprising;

a geared electrically-driven motor (46); and a transmission (45) connected to said electrically-driven motor (46) and including an output gear wheel (44) disposed in meshed engagement with said second pinion (41) for motor-driven rotation of said coupling shaft (37).

21. Apparatus in accordance with claim 19, further comprising a hand knob (43) on an upper free end (37*a*) of said coupling shaft (37) for enabling user-driven rotation of said coupling shaft.

22. Apparatus in accordance with claim 21, further comprising:

a geared electrically-driven motor (46); and a transmission (45) connected to said electrically-driven motor (46) and including an output gear wheel (44) disposed in meshed engagement with said second pinion (41) for motor-driven rotation of said coupling shaft (37).

23. Apparatus for the selectably alternative feeding of single sheets and of endless webs of paper in a printer having a printing station (14), an endless web push tractor (12) and a friction drive 917) for both single sheets and endless webs and disposed downstream of the printing station, the apparatus comprising:

a guide roll (7) disposed upstream of the printing station;

a first group of friction rollers (8) movable between a first position in which the rollers (8) contact the guide roll (7) for defining a first feed channel (4) through which single sheets are transportable, and a second position in which the friction rollers (8) are displaced from said first position of contact with the guide roll (7) for enabling the transport of endless webs through said apparatus;

a second group of friction rollers (9) spaced from said first group of friction rollers (8) circumferentially about said guide roll (7), said second friction rollers being movable between a first, relatively raised position of contact with the guide roll (7) for defining a second feed channel (5) through which single sheets are transportable and a second, relatively lower position for defining a third feed channel (6) through which endless webs are transportable by means of the push tractor (12) and the friction drive (17);

a printer base plate (18); and means for applying a variable contact pressure between said first group of friction rollers (8) and the guide roll (7) in said first and second positions of said first friction rollers (8), said means comprising:

a base plate member (24*b*) disposed on and for movement relative to said printer base plate (24);

a support spring (24) connected at one end to said first friction rollers (8) and at its other end (24*a*) to said base plate member (24*b*);

a spring pin (48) on said base plate member (24*b*); and a compression spring (49) on said spring pin (48) and extending between said base plate member (24*b*) and said printer base plate (18).

24. Apparatus for the selectably alternative feeding of single sheets and of endless webs of paper in a printer having a printing station (14), a bottom-disposed base plate having an opening through which single sheets are feedable to the printing station from below the printer for printing on the single sheets, an endless web push tractor (12), inlet means for feeding single sheets to the printing station from above the printer for printing on the single sheets, and a friction drive (17) for both single sheets and endless webs and disposed downstream of the printing station, the apparatus comprising:

a guide roll (7) separate from and disposed upstream of the printer station;

a first group of friction rollers (8) movable between a first position in which the rollers (8) contact the guide roll (7) for defining a first feed channel (4) through which single sheets fed from the base plate opening and from the inlet means are transportable to the printing station, and a second position in which the friction rollers (8) are displaced from said first position so as to contact the guide roll (7) with a reduced pressing force for enabling the transport of endless webs from the push tractor to the printing station, the base plate opening, said first feed channel and the printing station defining a path from the base plate opening to the printing station for single sheets fed to the printer through the base plate opening; and a second group of friction rollers (9) spaced from said first group of friction rollers (8) circumferentially about said guide roll (7), said second friction rollers being movable between a first, relatively raised position of contact with the guide roll (7) for defining a second feed channel (5) through which single sheets from the inlet means are transportable to the printing station and a second, relatively lower position for defining a third feed channel (6) through which endless webs are transportable from the push tractor (12) to the printing station, said second friction rollers being disposed remote from and out of said path of single sheets fed to the printer through the base plate opening.

25. Apparatus for the selectably alternative feeding of single sheets and of endless webs of paper in a printer having a printing station (14), an endless web push tractor (12) and a friction drive (17) for both single sheets and endless webs and disposed downstream of the printing station, the apparatus comprising:

a guide roll (7) disposed upstream of the printing station;

a first group of friction rollers (8) movable between a first position in which the rollers (8) contact the guide roll (7) for defining a first feed channel (4) through which single sheets are transportable, and a second position in which the friction rollers (8) are displaced from said first position so as to contact the guide roll (7) with a reduced pressing force for enabling the transport of endless webs through said apparatus;

a second group of friction rollers (9) spaced from said first group of friction rollers (8) circumferentially about said guide roll (7), said second friction rollers being movable between a first, relatively raised position of contact with the guide roll (7) for defining a second feed channel (5) through which single sheets are transportable and a second, relatively lower position for defining a third feed channel (6) through which endless webs are transportable by means of the push tractor (12) and the friction drive (17);

a printer base plate (18); and means for applying a variable contact pressure between said first group of friction rollers (8) and the guide roll (7) in said first and second positions of said first friction rollers (8), said means comprising:

a base plate member (24*b*) disposed on and for movement relative to said printer base plate (24);

a support spring (24) connected at one end to said first friction rollers (8) and at its other end (24*a*) to said base plate member (24*b*);

a spring pin (48) on said base plate member (24*b*); and a compression spring (49) on said spring (48) and extending between said base plate member (24*b*) and said printer base plate (18).

* * * * *